US006267304B1

(12) United States Patent
Schultz

(10) Patent No.: US 6,267,304 B1
(45) Date of Patent: Jul. 31, 2001

(54) VARIABLE DISCHARGE DISPENSING HEAD FOR A SQUEEZE DISPENSER

(75) Inventor: Robert S. Schultz, Old Greenwich, CT (US)

(73) Assignee: Emsar, Inc., Stratford, CT (US)

( * ) Notice: Subject to any disclaimer, the term of this patent is extended or adjusted under 35 U.S.C. 154(b) by 0 days.

(21) Appl. No.: 09/594,071

(22) Filed: Jun. 14, 2000

(51) Int. Cl.[7] ..... B65D 1/32

(52) U.S. Cl. ..... 239/327; 239/341; 239/539; 239/314; 239/403; 137/894; 222/206; 222/212

(58) Field of Search ..... 239/327, 356, 239/355, 362, 363, 366, 341, 368, 308, 311, 314, 338, 339, 340, 346, 537, 538, 328, 104, 103, 105, 434, 533.1, 570, 539; 137/894; 222/206, 211, 212, 215, 548, 631–633

(56) References Cited

U.S. PATENT DOCUMENTS

| | | | | |
|---|---|---|---|---|
| 3,102,691 | * | 9/1963 | Gall | 239/539 |
| 3,933,179 | * | 1/1976 | Hechler, IV | 137/894 |
| 3,940,069 | * | 2/1976 | Gunzel, Jr. et al. | 239/318 |
| 5,183,186 | | 2/1993 | Delaney, Jr. . | |
| 5,318,205 | | 6/1994 | Delaney, Jr. . | |
| 5,372,310 | * | 10/1994 | Ketcham | 137/894 |
| 6,012,650 | * | 1/2000 | Hadar | 239/403 |
| 6,050,504 | * | 4/2000 | Schultz | 239/434 |

* cited by examiner

*Primary Examiner*—David A. Scherbel
*Assistant Examiner*—Dinit Q. Nauyen
(74) *Attorney, Agent, or Firm*—Kenyon & Kenyon

(57) ABSTRACT

A dispensing head for a squeeze bottle sprayer includes a rotatable valve. The rotatable valve has both an air control notch and a fluid control notch. Upon rotation of the valve, the notches cooperate to vary the amount of air and or fluid discharged by the dispenser. The density of the stream may therefore be varied.

10 Claims, 3 Drawing Sheets

VARIABLE DISCHARGE DISPENSING HEAD FOR A SQUEEZE DISPENSER

FIELD OF THE INVENTION

This invention relates to a dispensing head for a dispenser which is pressurized by squeezing the sides of the container. More particularly, the invention is directed to a dispensing head in which air and liquid are mixed to produce a fine spray, and in which the density of the spray may be varied.

BACKGROUND OF THE INVENTION

Although squeeze bottle types sprayers have been used for many years, such sprayers were largely replaced for a long period of time by pressurized can dispensing systems. One squeeze bottle dispenser which has come into use as a substitute for pressurized cans is described in U.S. Pat. Nos. 5,183,186 and 5,318,205. These patents show a squeeze bottle dispenser in which an air passageway and a product (i.e., fluent material) passageway meet in a tapered mixing chamber. In the device of that invention, the tapering of the mixing chamber direct the air flow at an angle to the flow of liquid, resulting in turbulence in the liquid in the mixing chamber. This turbulence breaks the liquid up and intimately mixes it with the air. As a result, a fine spray is propelled out of the orifice.

One characteristic of current dispensers such as those described in U.S. Pat. Nos. 5,183,186 and 5,318,205 is that the amount and density of the spray is fixed. In other words, current dispensers only provide for either an open position, in which a fixed density spray is made or a closed position in which there is no spray.

SUMMARY OF THE INVENTION

Accordingly, it is an object of the invention to provide a spray dispensing device for use with a non-pressurized container, such as a squeeze bottle, which allows the density of the spray to be varied.

It is a further object of the invention to provide a valve which prevents the infiltration of air into the internal passages of the dispenser.

In accordance with the invention, a spray dispenser is provided having a dip tube which can extend into a container, such as a squeeze bottle, holding a quantity of liquid. The top of the dip tube is connected to a ball-check valve assembly having a ball which ordinarily rests on top of a conduit of restricted diameter. A rotatable valve has an air passage and a product passage. The air passage in the spray dispenser can connect the inside of the bottle with a mixing chamber in the dispenser. The separate product passage leads from the top of the ball-check to a mixing chamber and is directed toward a spray orifice in the mixing chamber. The air passage is an annular passageway which is concentrically disposed around a portion of the product passage leading to the mixing chamber. As the valve is rotated, the amount of communication between the air passage and product passage and the interior of the container is varied.

When the bottle is squeezed while the rotatable valve is open, the resulting pressure build up forces air into the mixing chamber and liquid up the dip tube. The liquid forces the ballcheck to open and the liquid is directed toward the mixing chamber. Simultaneously, air is forced through the annular air passage. The stream of air converges and impinges upon the core stream of liquid when deflected by tapered walls of the mixing chamber. This causes an atomization of the liquid and a fine spray is expelled through the orifice.

As the pressure in the bottle is relieved, the ball drops down back onto the conduit of restricted diameter thereby trapping product in the dip tube. Thus, the product will be retained in the dip tube at a high level, above the liquid level in the bottle, ready for the next squeeze cycle. In this way, the lag time which ordinarily occurs prior to spraying is eliminated.

The product passage is formed in a valve which is housed in a body of the spray dispenser. The valve may advantageously be formed as a rotatable valve which opens and closes the air and product passageways. In a closed position of the valve, both the product and air passageway are completely closed to the inside of the squeeze bottle, thereby preventing air from entering the inside of the squeeze bottle. The closing off of the passageways therefore reduces potential drying of the liquid product in the squeeze bottle.

The valve is formed so that as the valve is rotated from a closed position to a completely open position, the amount of communication between the interior of the container and the passages is varied. In this manner, the density of the spray can be varied.

Further objectives and advantages of the subject invention will be apparent to those skilled in the art from the detailed description of the disclosed invention.

DETAILED DESCRIPTION OF PREFERRED EMBODIMENTS

Figure 1:
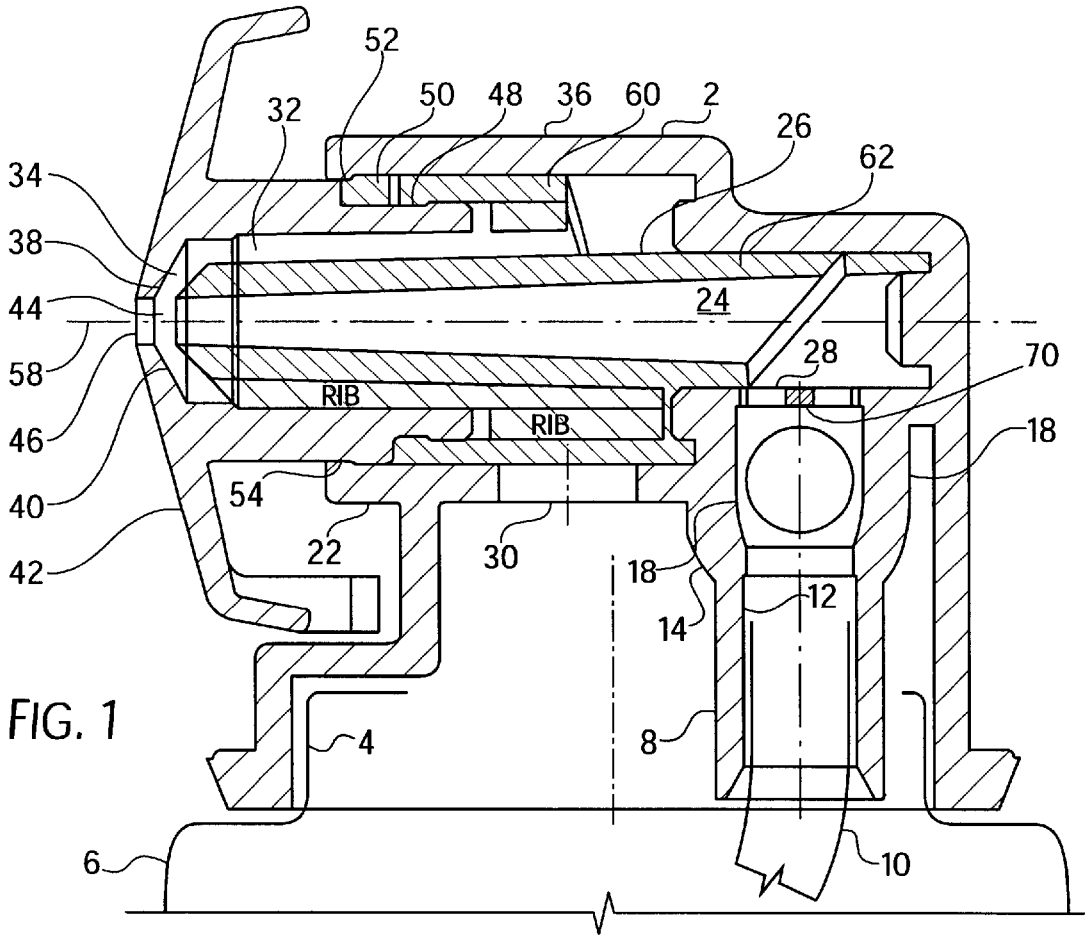
FIG. 1 is a cross-sectional view of the spray dispensing head of the present invention.
Figure 2:
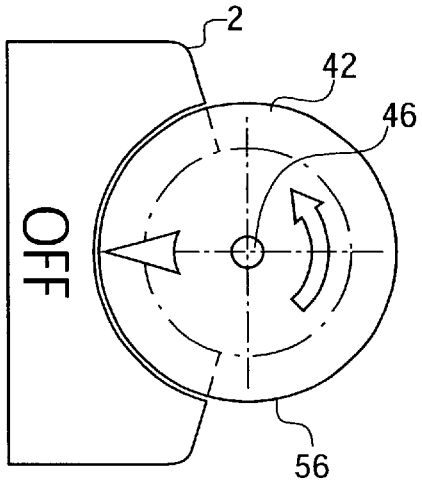
FIG. 2 is a side view of the spray dispensing head of the present invention.
Figure 3:
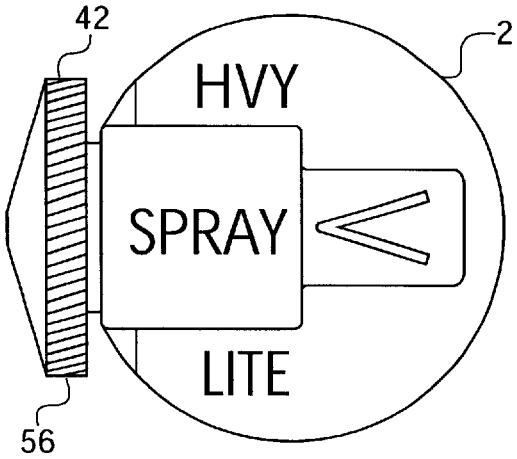
FIG. 3 is a top view of the spray dispensing head of the present invention.
Figure 4:
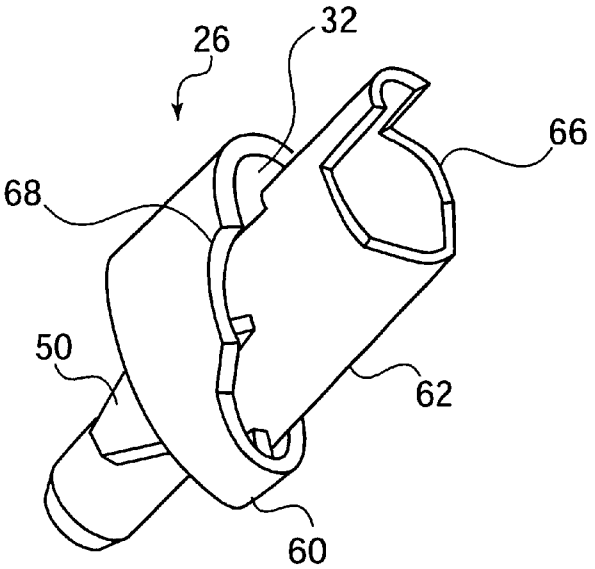
FIG. 4 is a perspective view of the valve of the present invention.
Figure 6:
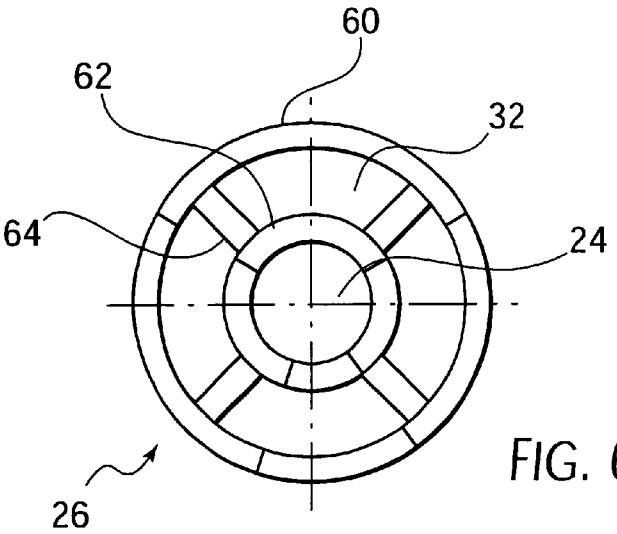
FIG. 6 is a side view of the valve.
Figure 5:
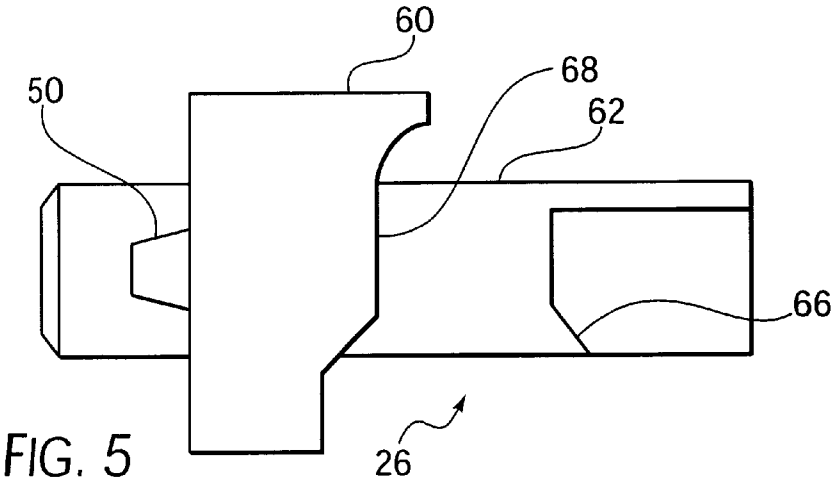
FIG. 5 is a frontal view of the valve.
Figure 7:
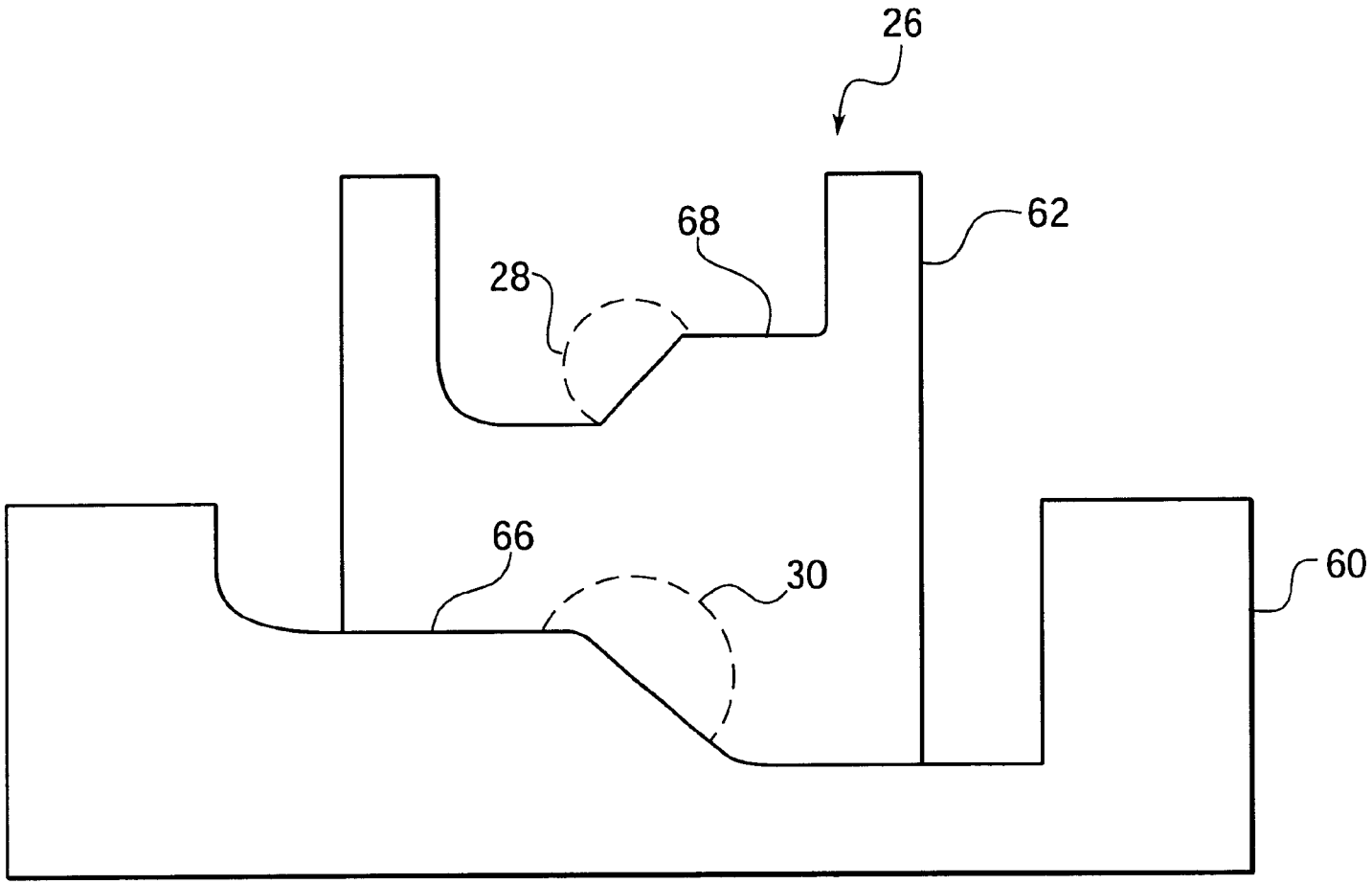
FIG. 7 is a layout view of the notched surfaces of the inlet valve.

FIG. 1 is a cross-sectional view of the spray-dispensing head of the present invention. The spray dispensing device housing 2 is adapted to be mountable atop a neck 4 of a bottle 6 in any manner known to those skilled in the art. The spray dispensing device housing includes a conduit 8 for receiving a dip tube 10.

A restricted conduit 12 of a ballcheck valve 14 receives the top end of the dip tube 10. The restricted conduit 12 communicates with the dip tube 10 so as to allow fluid to pass through. The inner diameter of the restricted conduit 12 is smaller than the diameter of the ball 16 of the ballcheck valve 14 so that the ball 16 ordinarily sits atop the restricted conduit 12. When the ball 16 is in this position, the ballcheck valve 14 is closed so that the top end of the dip tube 10 is also closed. The inner diameter of the remainder of the ballcheck valve 14 is larger than the diameter of the ball 16. In this way, the ball 16 is free to move upward in response to upward movement of fluid in the dip tube to open the ballcheck valve 14.

The top of the ballcheck valve 14 receives a coaxially disposed feed tube 18 which allows for the passage of fluid from the restricted conduit 12 through the housing 2. The feed tube 18 has a diameter which is substantially the same as the remainder of the ballcheck valve 14. A bar 70 is formed across the top of the feed tube 18, and can be oriented in any direction. The ball 16 is therefore free to move upward to open the ballcheck valve 14. Because the diameter of the feed tube 18 is larger than the diameter of the ball, product may flow freely past the ball.

For simplicity of construction, the feed tube 18 is an extension of a wall 22 of the housing 2. The feed tube 18 of the wall 22 can communicate with a product passageway 24 within a valve 26 when the valve 26 is in an open position through a product orifice 28. The wall 22 is also provided with an air orifice 30 which communicates with an annular air passageway 32. As illustrated in FIG. 1, the annular air passageway 32 is defined as the space between the inner surface of outer wall 60 of the valve 26 and the outer surface of the inner wall 62 of the valve 26 so that it is concentrically disposed around the portion of the product passageway 24 which leads to the air swirl passages 34 in an axial horizontal direction. The valve 26 is rotatably received in the cavity between the walls 22, 36 of the spray dispenser housing 2.

Tapered portions 38, 40 of a dial 42 define a cavity therebetween which shall be referred to as a mixing chamber 44. The tapered portions 38, 40 may define a cone. A portion of the product passageway 24 leads to the mixing chamber 44 in a generally horizontal direction. The annular air passageway 32 is concentrically disposed around the portion of the product passageway 24 which leads to the mixing chamber 44 in a horizontal direction. The tapered portions 38, 40 terminate before meeting to define a spray orifice 46 of the mixing chamber 44.

The dial 42 and valve 26 are housed within the cavity between the valve walls 22, 36 of the housing 2. The dial and valve are sized so that an extended portion 48 of the dial 42 fits within the valve. A locking tab 50 is formed by the outer wall 60 of the valve and cooperates with a recess 52 in the dial 42 so that when the dial is rotated, the valve is also rotated. A rim 54 on the spray housing restrains the dial 42 and valve 26 from falling out of the valve housing. The rim 54 is sized so that the dial and the valve may be assembled by pushing them past the rim. The perimeter 56 of the dial is grooved to allow easier gripping by a user.

The valve 26 is rotatable about its longitudinal axis between a heavy spray position and a completely closed position. An intermediate position provides a light spray. As shown in FIGS. 4–7, the valve 26 has an outer wall 60 joined to an inner wall 62 by ribs 64. The outer wall 60 of the valve has a profiled product control notch 66. The inner wall 62 of the valve has a profiled air control notch 68. Upon rotation of the valve 26, the walls 60, 62 of the valve 26 block more or less of the air orifice 30 and product orifice 28. In the completely closed position, the inner and outer walls are not notched. Consequently, the product passageway 24 is completely sealed from feed tube 18, and air passageway 32 is completely sealed from air orifice 30. As the valve is rotated, the notches 66, 68 in the valve walls 60, 62 allow communication between the feed tube 18 and the product passageway 28 and between the air orifice 30 and air passageway 32. Upon further rotation, the product control notch 66 in the outer wall 60 of the valve 26 reveals more of the product orifice 28, thereby allowing more communication between the product passageway 24 and the dip tube 10. Simultaneously, the air control notch 68 is shaped so that the inner wall 62 covers more of the air orifice 30, restricting communication between the interior of the squeeze bottle 6 and the air passageway 32. Accordingly, the spray will be denser in this position. When the valve 26 is rotated approximately midway between the heavy spray position and the fully closed position, the air and product orifices are at the positions indicated by the dashed lines in FIG. 7, providing a lighter spray. The notches in the valve walls may be modified to provide lighter or heavier sprays as the valve is rotated, depending on the application. The valve may be notched so that a stream of fluid is dispensed—i.e. product flow without air flow.

The operation of the spray dispensing device of the invention as used with a squeeze bottle will now be explained by describing the path of fluid and air. Upon squeezing the bottle 6 the pressure inside the bottle increases urging fluid 4 up dip tube 10. Fluid is forced through the restricted conduit 12 and pushes the ball 16 upward off the top of the conduit 8 thereby opening the ballcheck valve 14. The fluid is then free to flow into the feed tube 18 toward the product passageway 24. From the passageway 24 the fluid stream is injected into the mixing chamber 44 in a horizontal direction toward the spray orifice 46. It can be seen from FIG. 1 that the product passageway 24 communicates with the mixing chamber 44 at a location which is directly opposite the spray orifice 46.

Upon squeezing the bottle, the increase in pressure also forces air above the fluid level in the bottle through the air orifice 30 into the annular passageway 32. It can be seen that the distance which must be traveled by the air to reach the mixing chamber 44 is less than the distance which must be traveled by the liquid so that liquid does not reach the mixing chamber before the air. In this way, it is made certain that the fluid is mixed with air before emanating from the orifice 46.

The annular air passageway 32 leads to the mixing chamber 44 in a horizontal direction and communicates with the mixing chamber 44 at a location which is directly opposite the tapered or conical section 38, 40 of the mixing chamber. The tapered portions 38, 40 direct the annular air stream from the passageway 32 at an acute to a vertical angle to the central horizontal stream of liquid from the passageway 24. Thus, the annular stream of air converges and impinges upon the core stream of liquid at a point in proximity to the spray orifice 46. The liquid is subjected to considerable turbulence which breaks it up and intimately mixes it with the air. The result is that a fine spray is propelled out of the orifice 46 which exhibits a circular and symmetrical spray pattern wherein the droplets exhibit a symmetrical particle size distribution.

When pressure is released on the container it returns to its original shape as external air is drawn into the container through the orifice 46. The drawing of air through the orifice 46 cleans the orifice and the mixing chamber 44 after each squeeze cycle thereby inhibiting clogging of the orifice. This self-cleaning feature of the invention is particularly advantageous in the case of a viscous product where clogging is most frequently encountered.

The release of pressure also causes the liquid to drop down the feed tube 18 which helps the ball 16 to drop, thereby closing the top of the restricted conduit 12. It will be appreciated that the closing of the conduit 12 by the ball 16 will trap liquid in the feed tube 18. Thus, during the next squeeze cycle product will already be at a very high level in the dip tube so that less time will transpire before spay is emitted. In this way the present invention achieves nearly instantaneous spraying without the need for a pressurized container.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A squeeze bottle sprayer which is actuated upon squeezing the bottle to force liquid up a dip tube and emit a liquid-air spray through a spray orifice, comprising:

a squeezable bottle containing a volume of liquid and air above the liquid;

a dip tube extending into said volume of liquid;

a sprayer body defining a valve receptacle therein, having a valve, a tapered section defining a mixing chamber therein, the tapered section being tapered in a direction toward a spray orifice which is defined through the valve at a terminal point of the tapered section; the valve defining a liquid passageway there through connecting the dip tube with the mixing chamber in an open position of the valve, at least a portion of the liquid passageway being disposed in a direction toward the spray orifice and having a longitudinal axis aligned through said portion and said spray orifice, the valve defining a fluid control notch and an air control notch, the fluid control notch controlling the amount of communication between the dip tube and the product passageway, the air control notch controlling the amount of communication between the interior of the bottle and an air passageway, the valve and the liquid passageway being selectively rotatable about said longitudinal axis between a closed position wherein the mixing chamber is disconnected from the dip tube and an open position wherein the mixing chamber is connected to the dip tube;

the air passageway, concentrically disposed around said portion of the liquid passageway, the air passageway connecting an interior of the bottle containing said volume of air with the mixing chamber and the air passageway communicating with the mixing chamber at a location directly opposite to the tapered section of the sprayer body; wherein the mixing chamber is disconnected from the interior of the bottle in a closed portion of the valve and the air control notch controls the amount of communication between the interior of the bottle and the air passageway, whereby upon actuation of the squeeze bottle sprayer a stream of air from the air passageway will be deflected by the tapered section of the sprayer body to converge and impinge upon a core stream of liquid from the liquid passageway in the mixing chamber to atomize the stream of liquid.

2. The squeeze bottle sprayer of claim 1, further comprising a dial connected to the valve so that they rotate in unison.

3. The squeeze bottle sprayer according to claim 1, wherein the bottle has a neck with a retaining rim and the sprayer body is adapted to cooperate with the retaining rim to fasten the sprayer body to the bottle.

4. The squeeze bottle sprayer according to claim 1 further comprising a ball-check valve in fluid communication with the dip tube and the liquid passageway, wherein the ball-check valve retains liquid in the dip tube at a level which is higher than a level of liquid in the bottle upon activation of the container.

5. The squeeze bottle sprayer according to claim 1 wherein as the valve is rotated from a fully closed position to a fully open position, the fluid control notch is shaped so that more communication is allowed between the dip tube and the product passageway.

6. A dispensing head for a squeeze bottle sprayer comprising:

a sprayer housing defining a cavity therein, with an air orifice and a liquid orifice being defined through said housing;

a valve contained within the cavity, the valve defining an air passageway, a liquid passageway, a mixing chamber, and an outlet orifice, the valve being rotatable between an open position and a closed position, the valve including a profiled notched portion, the liquid passageway communicating with the mixing chamber and the liquid orifice in the open position of the spray nozzle, the air passageway communicating with the mixing chamber and the air orifice in the open position of the spray nozzle;

wherein the profiled-notched portion of the valve controls the amount of communication between the air orifice and the air passageway and between the liquid orifice and the liquid passageway.

7. The dispensing head of claim 6, further comprising means for retaining liquid in the dip tube at a level which is higher than a level of liquid in a container upon deactivation of the container.

8. The dispensing head according to claim 6, wherein the means for retaining liquid in the dip tube is a ball-check valve.

9. The dispensing head according to claim 6, wherein the notches include a fluid control notch and an air control notch.

10. The dispensing head according to claim 9, wherein the fluid control notch is shaped so that it provides more communication between the liquid orifice and the liquid passageway when the valve is rotated from a closed position to a heavier spray position.

* * * * *